US005943780A

United States Patent [19]

McIlhatten

[11] Patent Number: 5,943,780

[45] Date of Patent: Aug. 31, 1999

[54] CUTTER FOR FIBROUS COMPRESSIBLE MATERIAL

[76] Inventor: Edward T. McIlhatten, 40 Old Country Rd., Hudson, Mass. 01749

[21] Appl. No.: 09/056,565

[22] Filed: Apr. 7, 1998

Related U.S. Application Data

[60] Provisional application No. 60/045,037, Apr. 28, 1997.

[51] Int. Cl.[6] ..... B26B 3/08

[52] U.S. Cl. ..... 30/294; 30/286; 30/317

[58] Field of Search ..... 30/286, 290, 293, 30/294, 317, 314

[56] References Cited

U.S. PATENT DOCUMENTS

| | | | |
|---|---|---|---|
| 2,198,814 | 4/1940 | Hart | 30/286 |
| 2,743,523 | 5/1956 | Honey | 30/286 |
| 3,500,540 | 3/1970 | Lundquist | 30/294 |
| 3,613,241 | 10/1971 | Allen | 30/294 |
| 5,075,974 | 12/1991 | McIlhatten . | |
| 5,214,852 | 6/1993 | Napolitano | 30/317 |
| 5,325,594 | 7/1994 | Szafranski . | |
| 5,471,750 | 12/1995 | Deboi . | |
| 5,568,689 | 10/1996 | Gold . | |
| 5,581,893 | 12/1996 | Ouellette . | |
| 5,588,212 | 12/1996 | Riihimaki . | |

*Primary Examiner*—Hwei-Siu Payer
*Attorney, Agent, or Firm*—Emch, Schaffer, Schaub & Porcello Co., L.P.A.

[57] ABSTRACT

The cutter of my invention is a unitary device that does not require a utility knife, only a blade. The cutter exposes twice the blade length of a conventional utility knife, i.e., approximately 2.2 inches. The blade can be extended into the insulation over 4 inches. The cutter has a blade guard (to keep fingers out of the way, etc.). The cutter also has a safety mechanism to guard against accidental exposure of the blade (you have to grip the tool by the handle to allow the blade to be exposed). The cutter also has an added leverage point directly in front of the grip to increase the amount of pressure you can exert on the insulation. This cutter compresses and cut in one continuous motion, i.e. the same motion does both compressing and cutting.

19 Claims, 2 Drawing Sheets

CUTTER FOR FIBROUS COMPRESSIBLE MATERIAL

This application claims benefit of provisional application 60/045037, filed Apr. 28, 1997.

TECHNICAL FIELD

This invention relates to a cutter for fibrous compressible material such as thermal insulation batts.

BACKGROUND ART

Cutting thermal insulation batts is a very difficult and awkward task even for professional installers of this material. Very early cutters for insulation batts were nothing more than a very large pair of scissors or a conventional utility knife.

U.S. Pat. No. 5,075,974 granted to Edward McIlhaten on Dec. 31, 1991, discloses a substantial improvement in a cutting tool for use on insulation batts. The cutting tool comprises a utility knife housing, having a razor-type cutting blade, extending from one end thereof. The elongated housing is seated in a "U" shaped cradle that is attached to two parallel rods.

The parallel rods terminate in guide rings, near the end of the knife housing that carries the cutting blade. The parallel rods are reversely curved to form a spring system that includes a wire-like posts, extending upwardly through the above-mentioned guide rings. The spring system can be positioned against a batt of insulation to exert a compressing action on the fibrous batt material when a downward manual pressure is exerted on the knife housing. During downward motion of the knife housing, the guide rings slide down on the parallel posts, for the purpose of ensuring a true vertical motion of the knife housing. After the insulation batt has been compressed, the knife housing can be drawn across the batt surface so that the razor blade cuts through the compressed bat thickness.

U.S. Pat. No. 5,325,594 issued on Jul. 5, 1994, discloses a simple attempt at providing a batt insulation cutting tool. This tool is nothing more than a thick sheet of transparent plastic material, e.g., plexiglass, curved into a "C" shaped cross-section (when viewed along the edge of the sheet). Opposite ends of the curved plastic sheet have openings therein that fit around, or over, end areas of a conventional utility knife. This device does not provide much of a mechanical advantage to compress the batt. Nor does it provide much in the way of safety. No structure acts as a protective blade guard.

DISCLOSURE OF THE INVENTION

The cutter of my invention is a unitary device that does not require a utility knife, only a blade. The cutter exposes twice the blade length of a conventional utility knife, i.e., approximately 2.2 inches. The blade can be extended into the insulation over 4 inches. The cutter has a blade guard (to keep fingers out of the way, etc.). The cutter also has a safety mechanism to guard against accidental exposure of the blade (you have to grip the tool by the handle to allow the blade to be exposed). One embodiment has built-in carrying device in the form of a belt clip (you can clip it on your pants like a tape measure). Another embodiment changes the blade without any tools. I use a "live hinge" instead of a screw to hold the blade in place. I can accomplish this with a plastic mold. The cutter also has an added leverage point to increase the amount of pressure you can exert on the insulation. It is directly in front of the grip and it extends up towards your wrist.

The cutter of my invention has a handle spaced above a base, the handle having a front end and a rear end, the front end of the handle housing a cutting blade, wherein the rear end of the base curves upwardly to form a biasing means for maintaining the handle in an upper position. The rear end of the handle and biasing means are one piece in the preferred embodiment. Otherwise, the handle is attached to the biasing means. When the cutter is at rest with no pressure on the handle, the biasing means maintains the blade in a position above the upper surface of the base. When at rest, the base has a substantially horizontal bottom surface.

Downward pressure on the handle from an operator's hand is sufficient to overcome the biasing force of the biasing means for moving the blade in a downward position below the base. The pressure also causes the base to compress the fibrous material so that the cutting blade extends into the compressed fibrous material and cuts the compressed fibrous material as the cutter is moved along the upper surface of the fibrous material while maintaining downward pressure on the cutter. When an operator applies pressure to the handle, the substantially horizontal bottom surface of the base becomes curved or becomes U-shaped.

While I show my cutter in an exploded view for ease of understanding, my preferred construction is a unitary one piece tool except for the blade and safety bar.

BEST MODE OF CARRYING OUT INVENTION

Figures 1, 3:
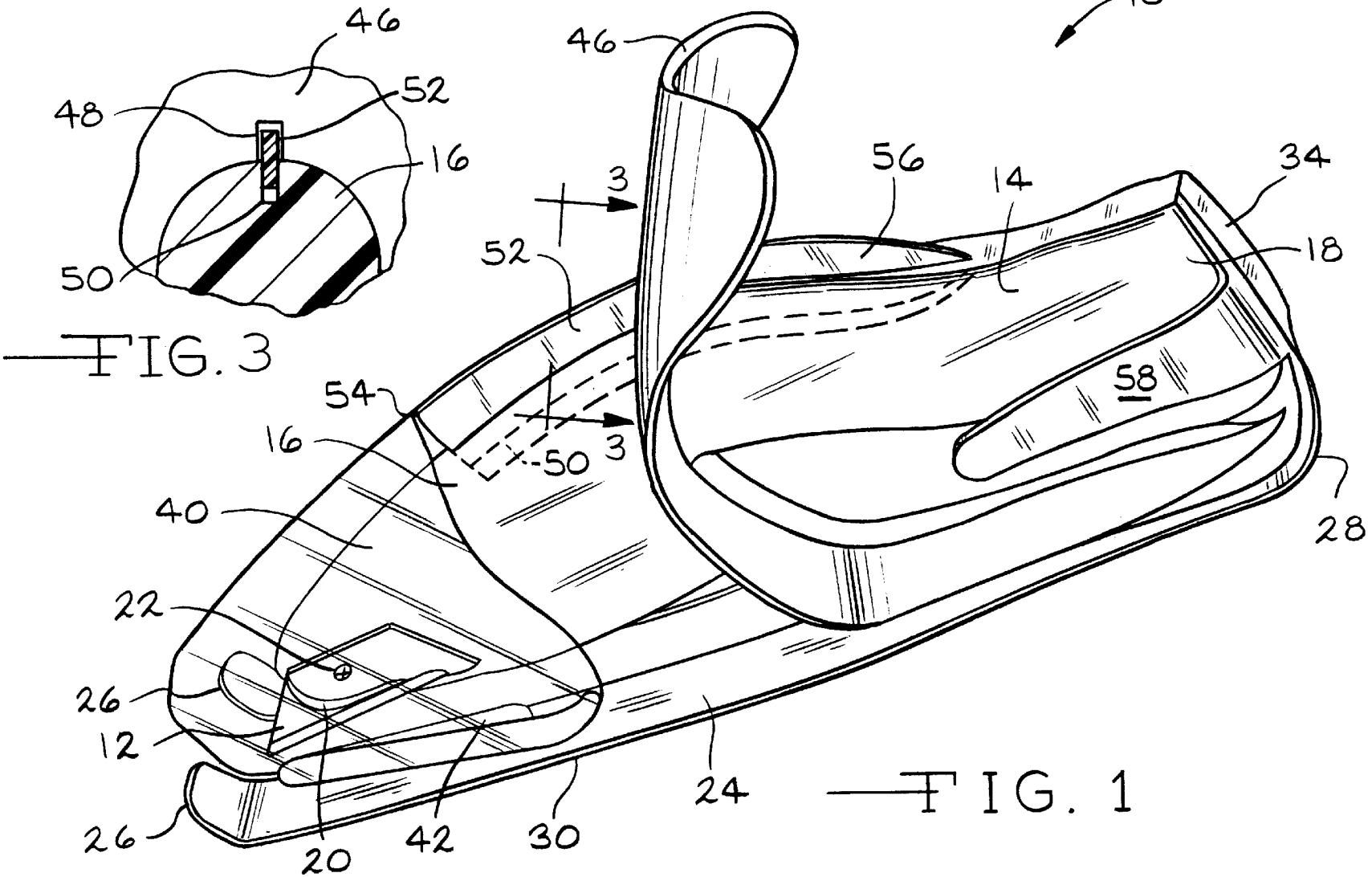
FIG. 1 is a side elevational view of a cutter embodying the principles of the present invention with no operator pressure on the handle.
FIG. 3 is a fragmentary cross-sectional view of FIG. 1 taken along line 3—3.

FIG. 1 shows cutter 10 according to the invention. Cutter 10 includes a cutting blade 12. Cutter 10 also includes an elongated handle 14 which has a front end 16 and rear end 18. Front end 16 defines an elongated cavity 20 for housing blade 12. A securing device 22 such as a screw or live hinge holds blade 12 in cavity 20.

Cutter 10 also includes an elongated base 24 having a front end 26 and a rear end 28. When at rest, base 24 has substantially a horizontal bottom surface 30 for resting on the upper surface of fibrous material (not shown) which is to be cut. Surface 30 guides cutter 10 along the upper surface of insulation (not shown). End 28 of base 24 curves upwardly away from bottom surface 30 to form biasing means 34 for yieldably maintaining handle 14 in an upper position.

Figure 2:
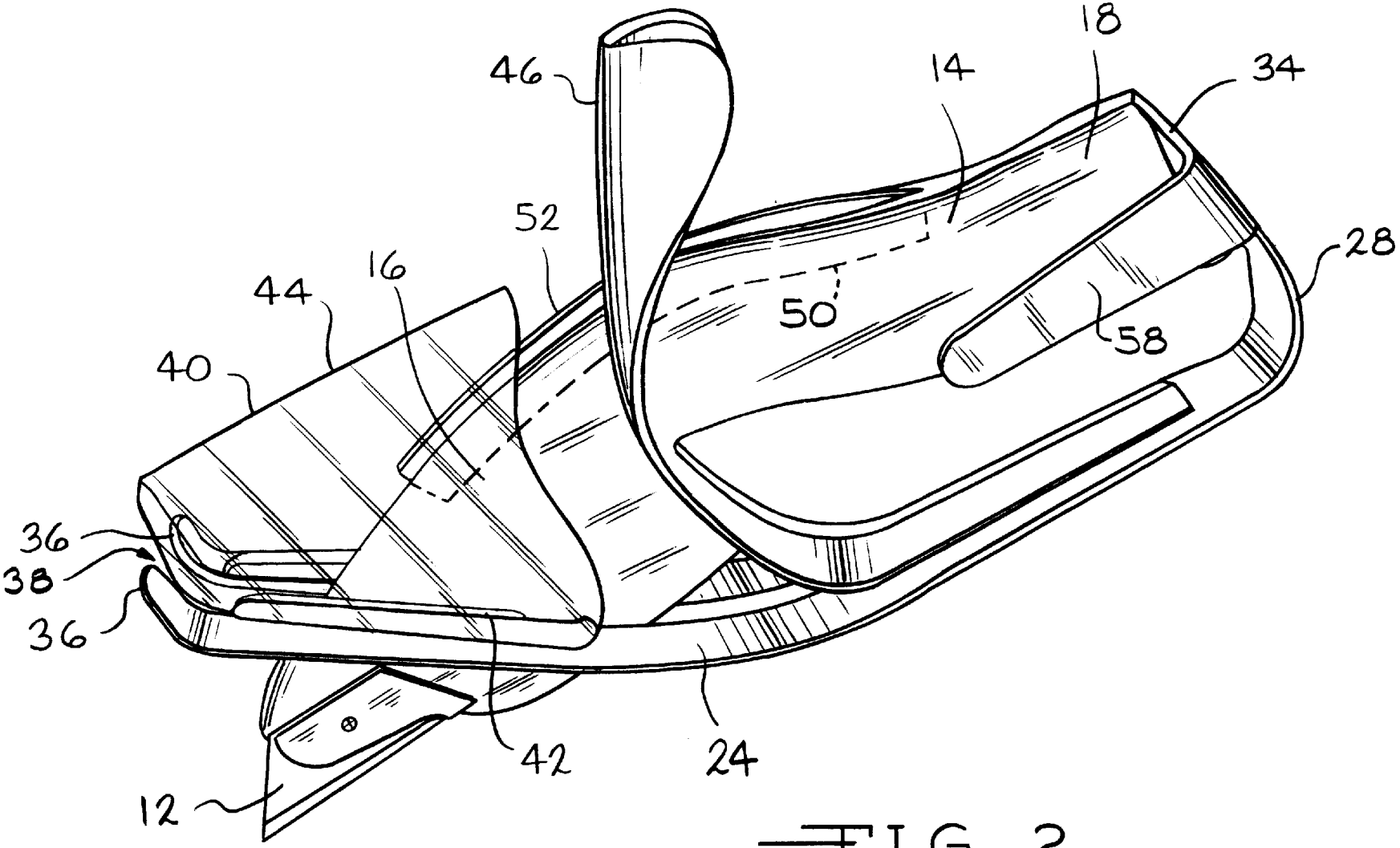
FIG. 2 is the same view with pressure on the handle.

FIG. 2 shows cutter 10 wherein downward pressure on handle 14 from an operator's hand is sufficient to overcome the biasing force of biasing means 34 for moving front end 16 of handle 14 to a lower position also causes base 24 to compress fibrous material so that cutting blade 12 extends into the compressed fibrous material and cuts the compressed fibrous material as cutter 12 is moved along the upper surface of the fibrous material while maintaining downward pressure on handle 14. FIG. 2 also shows base 24 is substantially curved or U-shaped when an operator applies pressure to handle 14.

Rear end 18 of handle 14 and biasing means 34 are molded as one piece without a fastening means such as a screw. In my preferred embodiment, handle 14, biasing means 34, base 24 and member 46 (or the entirety of cutter 10) are molded in a one-piece unitary design.

Front end 26 of base 24 comprises two elongated members 36 defining slot 38 which allows blade 12 to contact the upper surface of the fibrous material when an operator applies downward pressure on handle 14. The front ends of members 36 also can be joined, thereby making slot 38 an orifice instead.

The upper surfaces of elongated members 36 also support an inverted U-shaped blade guard 40. Legs 42 of guard 40 fasten to members 36 by conventional means or are of a unitary design with members 36. Fasteners (not shown) can be brackets defining slots which hold legs 42 in compression or members 36. Legs 42 and crown 44 of guard 40 define a cavity which houses front end 16 and blade 12. As a result, blade 12 is not exposed when handle 14 is in an upper position. In a preferred embodiment, the upper surface of base 24 supports upwardly extending member 46. Member 46 and handle 14 are molded as one piece. Member 46 acts as an additional leverage point to increase the amount of pressure an operator can exert on the insulation. Member 46 also acts as a guard to protect against operator injury.

In still another embodiment, the upper surface of handle 14 defines cavity 50 which houses a safety bar, elongated member 52. Member 52 has a front end 54 and rear end 56. Rear end 56 snaps into place in cavity 50 of handle 14. Front end 54 is free to move upwardly or downwardly in cavity 50. Downward pressure on member 52 is necessary to expose blade 12. When front end 54 is in the upward position, it contacts blade guard 40 and prevents blade 12 from being exposed. An operator has to grip handle 14 and safety bar member 52 to depress front end 54 below guard 40 and member 36 to allow blade 12 to be exposed. Cavity 48 of member 46 houses a portion of safety bar member 52 (the crown) then handle 14 is in the upper position.

When handle 14 is fully depressed and base 24 is U-shaped, member 46 may actually make contact with guard 40. The arrangement thereby acts as an additional safety stop. When handle 14 is fully depressed, cavity 48 no longer houses a portion of safety bar member 52. When handle 14 is fully depressed, safety bar 52 descends more fully into cavity 50.

In still another embodiment, biasing means 34 extends outwardly away from rear end 18 of handle 14 to form curved member 58 which acts as a belt dip. Member 58 may extend to the side or upwardly at any angle above the upper surface of base 24. Member 58 has to have a sufficient arc to act as a belt clip. Member 58 preferably curves toward the front end of cutter 10 so that blade 12 hangs downwardly in a vertical fashion.

FIGS. 1 and 2 also show the relationship of safety bar or member 52 to handle 14. It also shows how front end 54 of member 52 contacts blade guard 40 when member 52 is in an upward position. When handle 14 is in the upper position, slot 48 houses a portion of safety bar 52. The figures also clearly shows cavity 50 of handle 14.

Fragmentary FIG. 3 shows the relationship of safety bar 52, slot 48, cavity 50 and how they allow for the movement of safety bar 52 during cutting.

To change blade 12, an operator has to remove blade guard 40. First, he grips the tool by handle 14 depressing safety bar 52. Second, he squeezes blade guard 40 together at the bottom and push it back towards the grip. Third, he removes the screw and change blade 12. Last, he replaces blade guard 40. While I use a standard utility blade to show my cutter, one can use a variety of blades. For example, a four inch scrapper blade with rectangular or rounded edges would work quite well.

My cutter compresses and cuts in the same motion. This cutter utilizes 2 inches of its blade, whereas conventional insulation cutters utilize 0.75 inches of their blade. Both tools may use the same blade. The cutter's blade extends into the insulation up to 4 inches, typically 3.5 inches. The blade on a conventional insulation cutter extends one inch into the insulation. The cutter's ergonomic design reduces the amount of energy required to compress and cut fiberglass insulation. The cutter also is designed to cut all batt insulation, faced, unfaced and poly-wrapped with the least effort and the greatest accuracy.

It has a passive safety mechanism. Set it down or hang it from your side and the blade retracts inside its blade guard automatically. The cutter also has an active safety mechanism. It has a safety bar in the handle that requires that you grip the tool before the blade can be released. The cutter has a reversible belt clip (left or right hand operation) that enables you to carry it conveniently on your side. In one embodiment, the belt clip snaps out to open the blade storage compartment. I prefer to manufacture the cutter with a thermoplastic acetal resin. Delrin™ from DuPont is one such resin. One could easily manufacture the cutter from other resins with similar properties. The plastic I employ withstand abrasion better than stainless steel and have an extremely low coefficient of drag, so it will glide easily through the insulation.

Today's U.S. housing exceeds 95 million homes. Of these homes, 15% are insulated to today's standards, 40% have adequate insulation (they need more to meet today's standards) and 45% are under-insulated. 85% of U.S. homes need additional insulation. U.S. insulation sales reached five billion dollars in 1996. Building codes require insulation in all new construction. Three million do-it-yourselfers install insulation each year. Fiberglass insulation is the most widely used building insulation, commanding 85% of the market. Fiberglass insulation is cumbersome to install. No cutting tool in common use today compresses and cuts insulation in the same motion. The cutting tool of this invention does this with an upgraded ergonomic design and improved safety mechanisms. Compressing and cutting in one motion also provides greater accuracy in cutting.

I claim:

1. A cutter for cutting compressible fibrous material comprising a unitary one piece construction of:

an elongated base which has a front end, a rear end, an upper surface and an elongated substantially horizontal bottom surface for resting on the upper surface of fibrous material which is to be cut and for guiding the cutter along the upper surface of the material;

a handle spaced above the base, the handle having a front end, a central portion and a rear end, the front end of the handle housing a cutting blade which is attached to the unitary one piece construction at the front end of the handle;

the rear end of the base curving upwardly to form a biasing means for maintaining the handle in an upper position, wherein the rear end of the handle and the biasing means are one piece, wherein the handle also holds the blade above the base; and wherein downward pressure on the handle is sufficient to overcome the biasing force of the biasing means for moving the blade in a downward position below the base and also causes the base to compress the fibrous material so that the cutting blade extends into the compressed fibrous material and cuts the compressed fibrous material as the cutter is moved along the upper surface of the fibrous material while maintaining downward pressure on the cutter.

2. A cutter according to claim 1 wherein the base is substantially curved with downward pressure on the handle.

3. A cutter according to claim 1 wherein the base is substantially U-shaped with downward pressure on the handle.

4. A cutter according to claim 1 wherein the front end of the base comprises two elongated members defining a slot, wherein the slot allows the cutting blade to move below the bottom surface of the base when downward pressure is extended on the handle.

5. A cutter according to claim 1 wherein the front end of the base supports an inverted U-shaped guard defining a cavity which houses the front end of the handle and the cutting blade.

6. A cutter according to claim 5 wherein the handle has an upper surface defining a cavity, the handle also including a safety bar member wherein the cavity of the handle houses the safety bar member.

7. A cutter according to claim 6 wherein the safety bar member has a rear end and a front end, wherein the cavity of the handle holds the rear end of the safety bar member in place and the front end of the safety bar member is free to move upwardly and downwardly in the cavity of the handle.

8. A cutter according to claim 7 wherein the safety bar member contacts the U-shaped guard when in the upward position and is adjacent the cavity of the U-shaped guard when in the downward position.

9. A cutter according to claim 6 wherein the upper surface of the base supports an upwardly extending member, wherein the upwardly extending member includes a slot that houses a portion of the safety bar member when in an upper position, wherein the handle and the upwardly extending member are a unitary one piece construction.

10. A cutter according to claim 9 wherein the slot has a dimension that allows the safety bar member to move between the upper position and a lower position.

11. A cutter according to claim 9 wherein the upwardly extending member has a sufficient height and width to act as a guard to protect a user's hand.

12. A cutter according to claim 6 wherein the upper surface of the base supports an upwardly extending member, wherein the upwardly extending member of the base includes a slot wherein a portion of the safety bar member extends through the slot when the safety bar member is in an uppermost portion.

13. A cutter according to claim 12 wherein the cavity more fully houses the safety bar member when the handle is in the downward position.

14. A cutter according to claim 1 wherein the front end of the handle and the blade extend up to 4 inches below the base when the blade is in the downward position.

15. A cutter according to claim 1 wherein up to 2.2 inches of the blade extend below the base.

16. A cutter according to claim 1 wherein the cutter except for the blade is made of a resin which has a low coefficient of drag so that the bottom surface of the base will slide on fibrous material.

17. A cutter according to claim 16 wherein the resin is a thermoplastic.

18. A cutter according to claim 16 wherein the resin is an acetal resin.

19. A process for compressing and cutting compressible fibrous material comprising the step of compressing and cutting with one continuous motion with the cutter according to claim 1.

* * * * *